US007228893B2

(12) United States Patent
Matsuzaki et al.

(10) Patent No.: US 7,228,893 B2
(45) Date of Patent: Jun. 12, 2007

(54) HEAT EXCHANGE UNIT

(75) Inventors: Toyoaki Matsuzaki, Shizuoka (JP); Taro Watanabe, Tokyo (JP)

(73) Assignee: Xenesys Inc. (JP)

( * ) Notice: Subject to any disclaimer, the term of this patent is extended or adjusted under 35 U.S.C. 154(b) by 102 days.

(21) Appl. No.: 11/212,670

(22) Filed: Aug. 29, 2005

(65) Prior Publication Data

US 2006/0060339 A1 Mar. 23, 2006

(30) Foreign Application Priority Data

Sep. 9, 2004 (JP) ..... 2004-262950

(51) Int. Cl.
*F28F 3/00* (2006.01)

(52) U.S. Cl. ..... 165/166; 165/164

(58) Field of Classification Search ..... 165/164, 165/166, 167

See application file for complete search history.

(56) References Cited

U.S. PATENT DOCUMENTS

| | | | | |
|---|---|---|---|---|
| 3,912,004 A | 10/1975 | Darm et al. | | |
| 4,183,403 A | 1/1980 | Nicholson | | |
| 5,699,856 A | 12/1997 | Merle | | |
| 6,286,589 B1 * | 9/2001 | Uehara | 165/166 | |
| 2005/0150644 A1 * | 7/2005 | Matsuzaki | 165/166 | |

FOREIGN PATENT DOCUMENTS

| | | | |
|---|---|---|---|
| GB | 901 914 A | | 7/1962 |
| JP | 53-56748 | * | 5/1978 |
| JP | S53-56748 | | 5/1978 |
| JP | 2003-194490 | | 7/2003 |

OTHER PUBLICATIONS

European Search Report dated Jan. 16, 2006.

* cited by examiner

*Primary Examiner*—Teresa J. Walberg
(74) *Attorney, Agent, or Firm*—Rader Fishman & Grauer PLLC; Ronald P. Kananen

(57) ABSTRACT

A heat exchange unit is composed of rectangular heat transfer panels with terraced flat portions, combined in parallel and integrally with each other to form first and second spaces. Outer and inner reinforcement members having respective serrations are welded to the panels so that the serrations are inserted into gaps between the heat transfer panels. The outer and inner reinforcement members are made of the same material as the heat transfer panels and have a larger thickness than the heat transfer panel, so as to bear high heat input given during the welding. The heat input caused by welding can be increased to enable portions of the heat transfer panels to be melted rapidly.

11 Claims, 12 Drawing Sheets

HEAT EXCHANGE UNIT

BACKGROUND OF THE INVENTION

1. Field of the Invention

The present invention relates a heat exchange unit, which comprises a plurality of heat transfer panels, which are formed of a metallic thin sheet and combined in parallel and integrally with each other, and especially to such a heat exchange unit in which heat exchange fluid having a high pressure can be introduced between the heat transfer panels.

2. Description of the Related Art

If there is a demand that heat transfer coefficient is increased to enhance heat exchange effectiveness, utilizing a heat exchanger by which heat exchange is made between a high temperature fluid and a low temperature fluid, a plate-type heat exchanger has conventionally been used widely. The plate-type heat exchanger has a structure in which a plurality of heat transfer panels having a plate-shape are placed parallelly one upon another at prescribed intervals so as to form passages, which are separated by means of the respective heat transfer panel. A high temperature fluid and a low temperature fluid flow alternately in the above-mentioned passages to make heat exchange through the respective heat transfer panels. Japanese Patent Provisional Publication No. S53-56748 describes an example of such a conventional plate-type heat exchanger.

In the conventional plate-type heat exchanger, gasket members formed of elastic material are placed between the adjacent two plates to make the distance between them constant and define passages for fluid. However, a high pressure of the heat exchange fluid flowing between the plates may cause deformation of the gasket member, thus disabling an appropriate separation of the fluids from being ensured or leading to an unfavorable variation in distance between the plates. In such a case, an effective heat exchange may not be carried out, thus causing a problem. In view of these facts, the conventional heat exchanger involves a problem that the heat exchange fluids can be utilized only in a pressure range in which the gasket member withstands.

There has recently been proposed a heat exchanger having a structure in which metallic thin plates, which are placed at predetermined intervals, are joined together, without using any gasket members, at their ends by welding to assemble the plates into a single unit so as to form passages for heat exchange fluids, on the opposite sides of the respective plates. Japanese Patent Provisional Publication No. 2003-194490 describes, as an example of an invention made by the present inventor, a heat exchange unit in which heat transfer panels formed of metallic thin plates are aligned in parallel with each other so as to be apart from each other, these plates are welded at their periphery excepting one side into a united body having an opening, and the opening is closed by an end plate.

Japanese Patent Provisional Publication Nos. S53-56748 and 2003-194490 describe the conventional heat exchanger (heat exchange unit). Especially, in the prior art described in the latter publication, a pair of heat transfer panels are welded together at flat portions on their opposite two sides, thus preparing a combined body section. The same step as mentioned above is repeated to prepare a plurality of combined body sections. A pair of combined body sections thus prepared are welded together at flat portions on their other opposite two sides and the same step as mentioned above is repeated to prepare a single combined body. Such a single combined body is inserted into an opening provided in the middle of an end plate, and then, the heat transfer plates and the end plates are welded together, thus ensuring a state in which openings formed on the respective sides of the heat transfer panels are separated from each other.

It is possible to weld the heat transfer panels together at their flat portions in an effective manner by mainly applying a seam welding. However, when a pair of combined body sections and another pair of combined body sections are welded together, a physical restriction that the distance between the combined body sections is relatively small makes it impossible for an electrode of the seam welding machine to reach the end of the flat portion, thus leading to difficulty in operation of the seam welding. There is no choice but to apply a different type of welding method to such a region to which the seam welding cannot be applied, thus causing problems that a general welding operation becomes time-consuming and strength of the welded portions utilizing the above-mentioned different type of welding method is deteriorated in comparison with the welded portion utilizing the seam welding method.

In addition, when one of objects to be welded has a relatively smaller thickness than the other as in case where the end plate and the heat transfer plates are welded together, it is difficult to automatically control the welding, since an excessively high heat may melt the smaller thickness object unless a severe control of generated heat is made. Further, there is need to connect water-tightly the end plate to the heat transfer panels over serrations of the end plate, which are placed along the heat transfer panels, as well as portions of the end plate, which define the opening for the single combined body and have a complicated shape, so as to keep the fluid openings of the heat transfer panels in a properly separated state. In view of such circumstances, there has been no choice but to apply a fillet welding as the welding method for such a structure. However, there is need to carry out carefully a welding operation along portions to be welded, having complicated shapes, resulting in a low operation efficiency. In addition, there is also a problem that the resultant welded structure does not have a sufficient strength against pressure of heat exchange fluids. There is a further problem that sputters, which come from the welded portion into the fluid opening of the heat transfer panels during the welding operation, are deposited on the surface of the heat transfer panel and may be left as particles that freely move within the space between the heat transfer panels.

In case where liquid having a high metallic corrosion property such as seawater is used as heat exchange fluid, titanium is used as material for forming the heat transfer panels. A gas-shielded arc welding is applied to weld such panels made of titanium, due to its high reactivity. There is limitation in heat generated in welding of the end plate and the heat transfer panels, as mentioned above, with the result that there is no choice but to apply a TIG welding in which a precise control of generated heat can be made. However, there are problems that a welding speed is low, a gap between objects to be welded is required to be small in order to enhance welding precision for the objects to be welded, thus causing many limitations in welding, and a general welding operation becomes time and cost-consuming.

SUMMARY OF THE INVENTION

An object of the present invention, which was made to solve the above-mentioned problems, is therefore to provide a heat exchange unit in which a partial improvement to a separation structure of openings of heat transfer panels as combined is made to permit an efficient welding applied between structural components and ensure a water-tight separation of passages for different fluids, thus making it possible to use heat exchange fluids having higher pressure.

In order to attain the aforementioned object, a heat exchange unit of the first aspect of the present invention comprises: a plurality of heat transfer panels, which are formed of a metallic thin sheet and combined in parallel and integrally with each other, each of the heat transfer panels being provided with opposite surfaces with which first and second heat exchange fluids are to come into contact, respectively, first spaces through which the first heat exchange fluid is to pass and second spaces through which the second heat exchange fluid is to pass being provided alternately, and first openings communicating respectively with the first spaces to cause the first heat exchange fluid to flow into and out from the first spaces and second openings communicating respectively with the second spaces to cause the second heat exchange fluid to flow into and out from the second spaces being provided separately from each other, wherein: each of the heat transfer panels is formed into a rectangular shape, and provided at one or more position in at least a pair of opposite sides in an outer periphery thereof with a terraced flat portion that is elevated from an area therearound; of the plurality of heat transfer panels, adjacent two heat transfer panels between which the first space is located are water-tightly welded together at corresponding sides except for the terraced flat portion in a state in which respective inner surfaces of adjacent two terraced flat portions face each other so that a first gap between opposing two terraced flat portions communicates with the first opening, and adjacent two heat transfer panels between which the second space is located are water-tightly welded together at outer surfaces of adjacent two terraced flat portions, to provide an integrally assembled body in which the first gaps between the terraced flat portions disposed in parallel with each other serve as the first openings; there is provided an outer reinforcement member having a plurality of serrations placed in a row, each of the serrations having a shape by which a second gap between the adjacent heat transfer panels is substantially closed over a predetermined area in a vicinity of the first space on an end side thereof, the outer reinforcement member being formed of a same material as the heat transfer panel and having a larger thickness than the heat transfer panel, the each of serrations being inserted into the predetermined area of the second gap to place the outer reinforcement member in a combining direction of the heat transfer panels; there is provided an inner reinforcement member having a plurality of serrations placed in a row, each of the serrations having a shape by which the first gap between the adjacent heat transfer panels is substantially closed over a predetermined area in a vicinity of the second gap on an end side thereof, the inner reinforcement member being formed of a same material as the heat transfer panel and having a larger thickness than the heat transfer panel, the each of serrations being inserted into the predetermined area of the first gap to place the inner reinforcement member in a combining direction of the heat transfer panels; and each of the serrations of the outer and inner reinforcement members are welded to the heat transfer panels at predetermined regions without forming a clearance between the serrations and the heat transfer panels.

According to the first aspect of the present invention, each of the heat transfer panels, which is formed of a metallic thin sheet into a rectangular shape, has the terraced flat portions formed on the two sides of the heat transfer panel, and such heat transfer panels are combined in parallel and integrally with each other by welding the adjacent two panels at their predetermined positions. In addition, the outer reinforcement member and the inner reinforcement member that have the serrations having the respective shapes corresponding to the inner and outer sides of the first space between the adjacent terraced flat portions of the heat transfer panels are placed in the combining direction of the heat transfer panels. Welding is applied to the respective serrations that are inserted between the heat transfer panels so that portions of the heat transfer panel, each of which is placed between the adjacent serrations, are welded together with the serrations to seal gaps between the heat transfer panel and the serrations. As a result, there are formed, on the end side of the space, welded portions in which the reinforcement member and the portions of the heat transfer panels are strongly combined to each other. It is therefore possible to ensure a state in which the first opening and the adjacent second opening are water-tightly separated from each other at the welded portions of the respective reinforcement members extending in the combining direction of the heat transfer plates. In addition, strength of the combined heat transfer panels into a unit can be remarkably enhanced so as to cope with a case where difference in pressure between the heat transfer fluids is relatively large. Further, the serrations of the respective reinforcement members are inserted into the paces between the heat transfer panels to expand the portions to be welded, and then the welding is applied to weld them together. Accordingly, allowance for heat input during the welding can improved to permit welding at high speed requiring a large amount of heat input, thus providing a remarkable improvement in welding efficiency, without causing unfavorable fusion. In addition, the reinforcement members form continuous walls disposed on the opposite sides of the welded portion, thus preventing sputters, which may be caused during the welding, from coming from the welded portion into the opening such as the first opening.

In the second aspect of the heat exchange unit of the present invention, there may be adopted a structure in which the adjacent heat transfer panels between which the second space is placed are combined into a united body by a seam welding at weldable regions on the outer surfaces of the adjacent two terraced flat portions; each of the serrations of the inner reinforcement member has a length so that the serration is capable of existing on at least a side of each of both ends of the terraced flat portions as combined, an electrode of a seam welding machine being incapable of physically extending to the at least the side to provide an unweldable region; and welding applied between the serrations that are inserted into the space between the terraced flat portions forming the first opening over the unweldable region causes the heat transfer panels to be welded simultaneously together.

According to the second aspect of the present invention, the size of the serrations of the inner reinforcement member is so sufficiently large that the serrations can reach the side of the unweldable region in which the welding cannot be applied by the seam welding for the heat transfer panels. When the heat transfer panels are welded together with the inner and outer reinforcement members, portions at the unweldable region of the heat transfer panels are simultaneously melted for fusion welding, so as to provide a continuous welded portion extending from the welded portion to the edge of the terraced flat portion. Therefore, there is no need to carry out independently a welding operation that is to be applied to non-welded portions after completion of the seam welding, thus improving welding efficiency. In addition, strength of portions that would have been joined by the other kind of welding method than the seam welding method, after completion of the seam welding, can be remarkably increased by combination of the heat transfer panels with the reinforcement members, without causing deterioration in strength in comparison with the seam welded portions. Such a general structure of the heat exchange unit can cope with a case where difference in pressure between the heat exchange fluids is relatively high, so as to ensure a reliable separation between passages for the fluids.

In the third aspect of the heat exchange unit of the present invention, the outer reinforcement member and/or the inner reinforcement member may be provided at an opposite edge to the serrations with a flange that is substantially flat, the flange being to be in parallel to the combining direction of the heat transfer panels and spaced apart from an edge of the first opening of the adjacent two heat transfer panels.

According to the third aspect of the present invention, the outer reinforcement member and/or the inner reinforcement member has at the edge thereof the flange that is in parallel to the combining direction of the heat transfer panels so that the flange separates the first space and the second space of the combined heat transfer panels in the same manner as the outer reinforcement member and the inner reinforcement member. When the combined unit of the heat transfer panels is secured for example in a casing through the flanges, there can easily be ensured a state where the first space and the second space are separated from each other in an appropriate manner. The unit is secured by the other portion of the heat transfer panels, thus increasing the mounting strength and improving a mounting operation for the unit. The manufacturing cost for the heat exchange unit can be reduced remarkably.

In the fourth aspect of the heat exchange unit of the present invention, the welding applied between the serrations of the outer reinforcement member and the inner reinforcement member may be carried out by an arc welding with a consumable electrode having a wire-shape, in which an electrode unit provided with the electrode is moved between the outer reinforcement member and the inner reinforcement member, while generating an arc between the electrode, and the serrations of the outer reinforcement member, the serrations of the inner reinforcement member and the heat transfer panels, whereby the serrations of the outer reinforcement member, the serrations of the inner reinforcement member and the heat transfer panels are welded together with the electrode formed of a same material thereof.

According to the fourth aspect of the present invention, the arc welding with the consumable electrode is applied to weld the serrations of the outer reinforcement member and the inner reinforcement member together with the heat transfer panels, to generate arc between the electrode made of the same material as the heat transfer panels, the serrations and the heat transfer panels so as to increase heat input caused by the arc, thus enabling the portions to be welded to be melted rapidly and supply a molten amount of the electrode to the portions to be welded to ensure a sufficient amount of molten metal thereon. As a result, it is possible to achieve a progress of an operation of melting the portions to be welded in a reliable manner, merely by moving the electrode unit along a simple guiding line in the combining direction of the heat transfer panels, thus permitting remarkable improvement in welding operation efficiency and achievement of an automatic welding.

In the fifth aspect of the heat exchange unit of the present invention, the heat exchange unit may further comprises a side sealing member that is water-tightly connected to the outer surface of the terraced flat portion of an outermost heat transfer panel of the heat transfer panels as welded together and respective edges of the outer reinforcement member and the inner reinforcement member in the combining direction of the heat transfer panels to prevent the second heat exchange fluid from flowing from a side of the outermost heat transfer panel into the first opening.

According to the fifth aspect of the present invention, the side sealing member is disposed so as to be integral with the surface of the outermost terraced flat portion of the heat transfer panels as combined into the unit, and with the respective edges of the outer and inner reinforcement members in the combining direction of the heat transfer panels, with the result that separation can be ensured for the first openings also on the opposite side to the reinforcing members, in the same manner as such reinforcing members. Consequently, it is possible to apply, when the combined unit of heat transfer panels is secured for example in a casing, the welding operation to such a side sealing member. There is no need to carry out directly a connection operation for connection relative to the heat transfer panels, thus providing excellent effects not only in operability, but also in separation as secured between the first and second openings. In addition, not only mounting strength, but also strength of the unit itself can be increased, thus coping with the heat exchange fluids having a higher pressure.

In the sixth aspect of the heat exchange unit of the present invention, the side sealing member may be provided at its edge that is away from a joined portion of the side sealing member to the heat transfer panel, with a flange that is substantially flat, the flange extending outward or inward relative to the first opening by a predetermined length.

According to the sixth aspect of the present invention, the side sealing member has at the edge thereof the flange that is in parallel to the edges of the heat transfer panels, so that the flange separates the first space and the side portions of the heat transfer panels in the same manner as side sealing member. When the combined unit of the heat transfer panels is secured for example in a casing through the flanges, there can easily be ensured a state where the first space and the second space are separated from each other in an appropriate manner. The unit is secured by the other portion of the heat transfer panels, thus increasing the mounting strength and improving a mounting operation for the unit. The manufacturing cost for the heat exchange unit can be reduced remarkably.

DETAILED DESCRIPTION OF THE PREFERRED EMBODIMENTS

Figure 1:
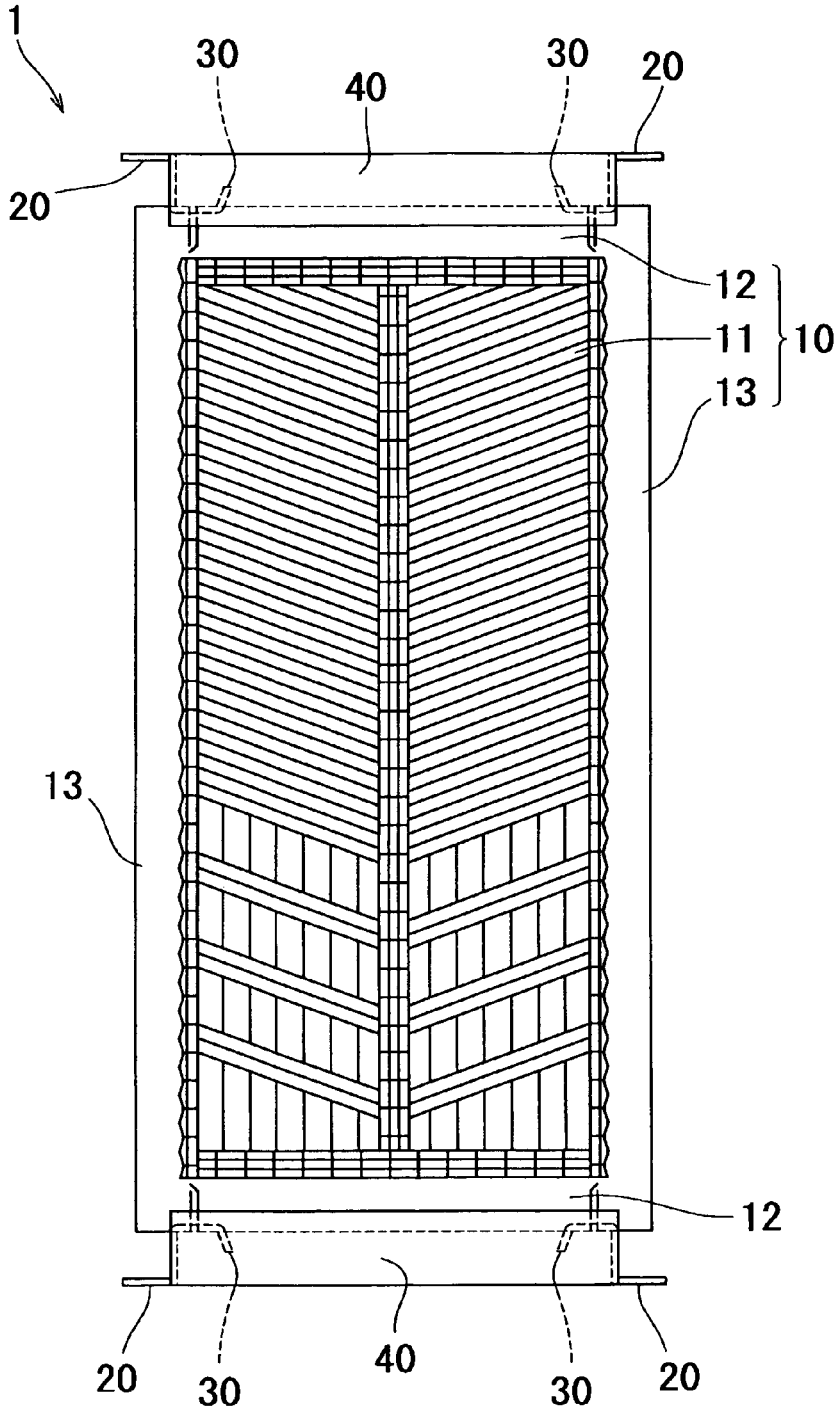
FIG. 1 is a side view illustrating a heat exchange unit according to an embodiment of the present invention.
Figure 2:
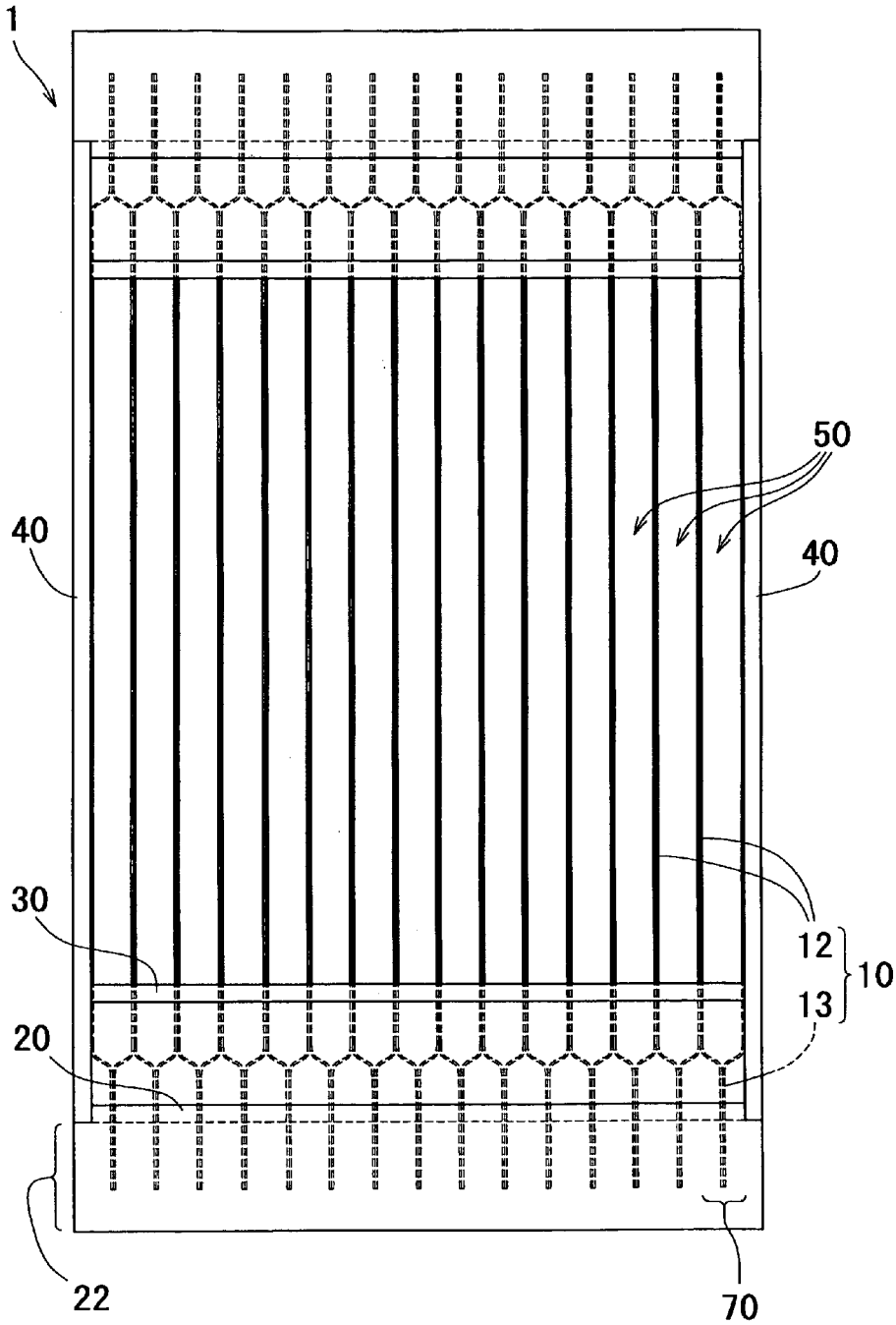
FIG. 2 is a plan view illustrating the heat exchange unit according to the embodiment of the present invention.
Figure 3:
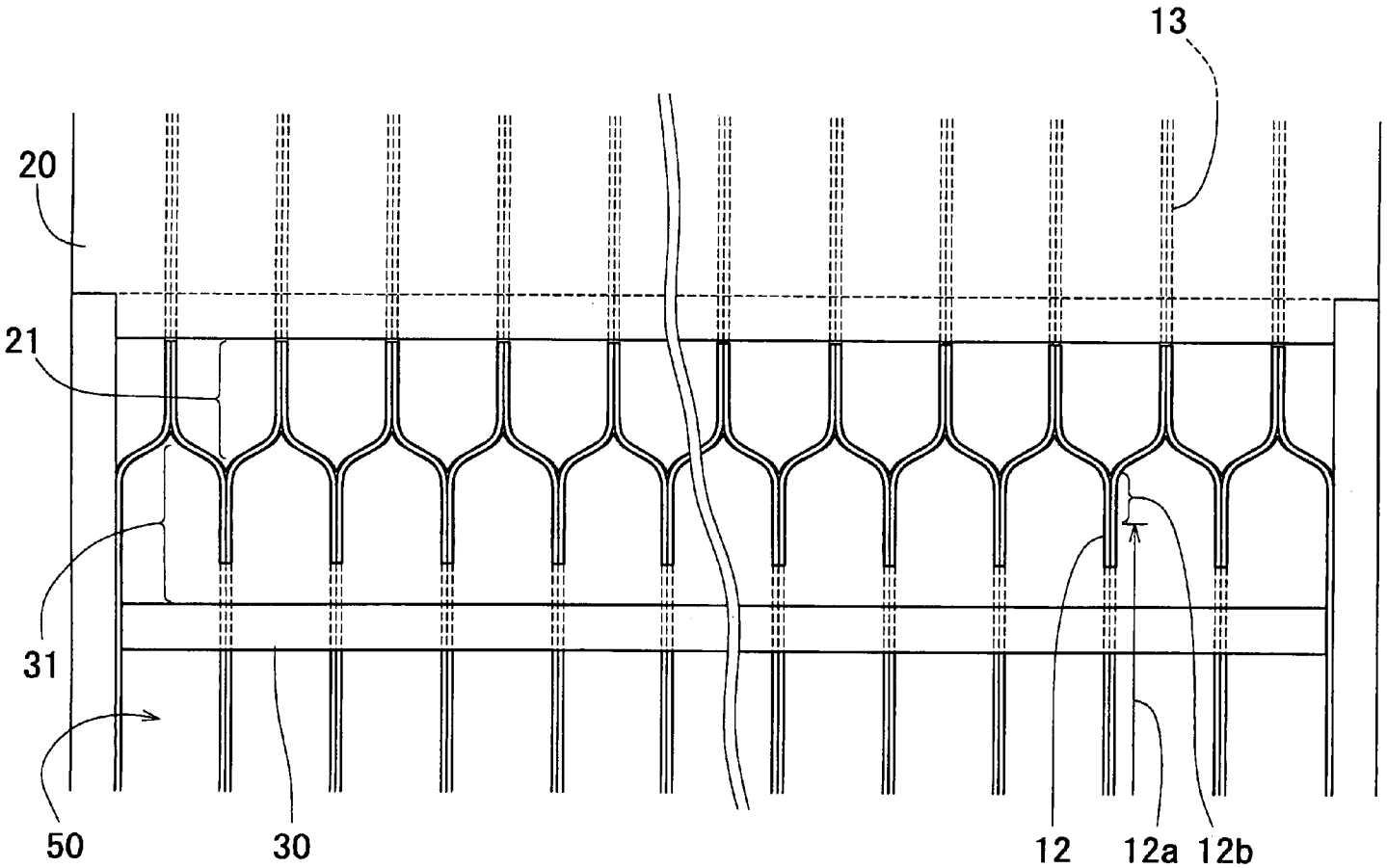
FIG. 3 is an enlarged view illustrating essential elements of the heat exchange unit according to the embodiment of the present invention, in which heat transfer panels and reinforcement members have not as yet been welded together.
Figure 4:
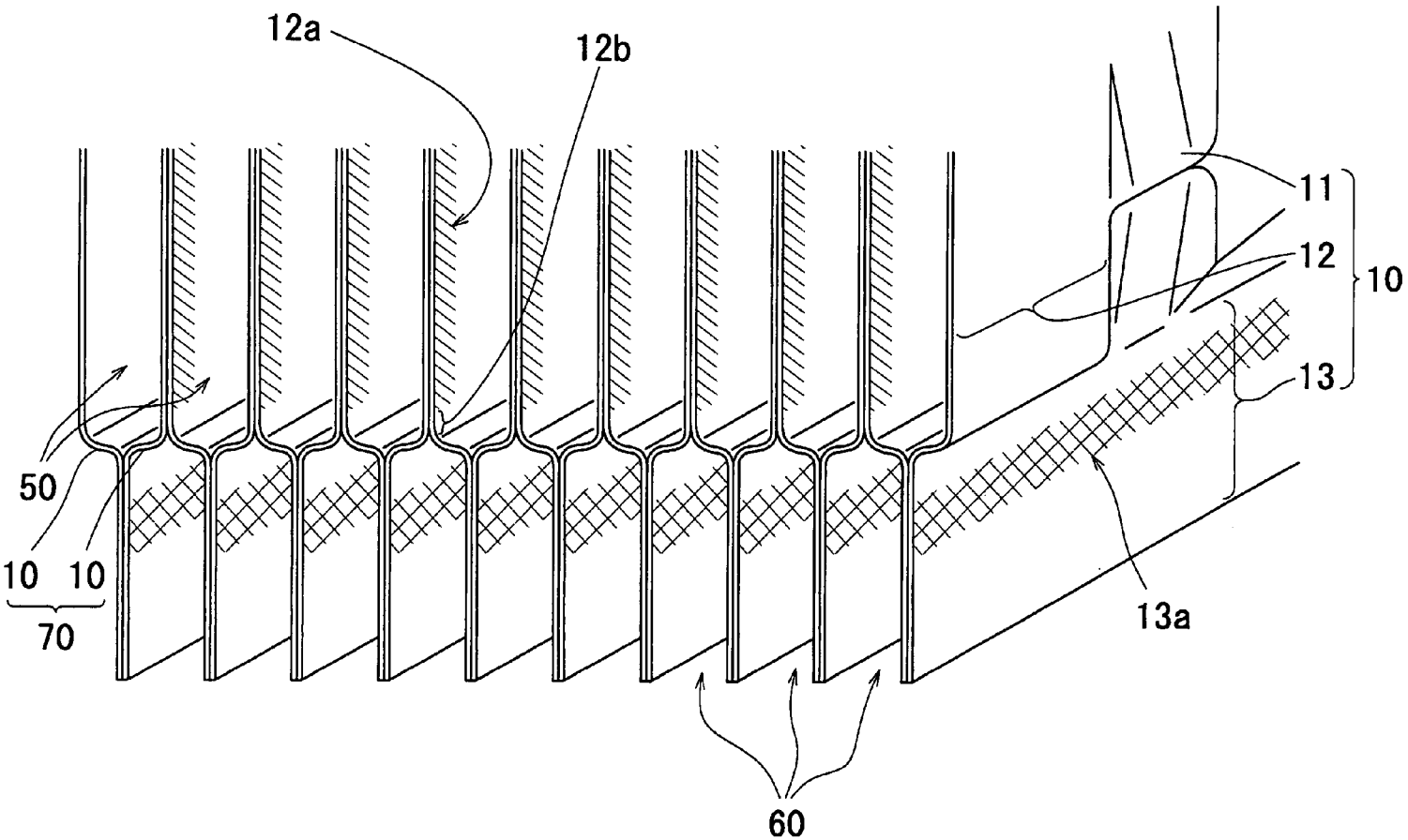
FIG. 4 is a perspective view of a combined state of the heat transfer panels of the heat exchange unit according to the embodiment of the present invention.
Figure 5:
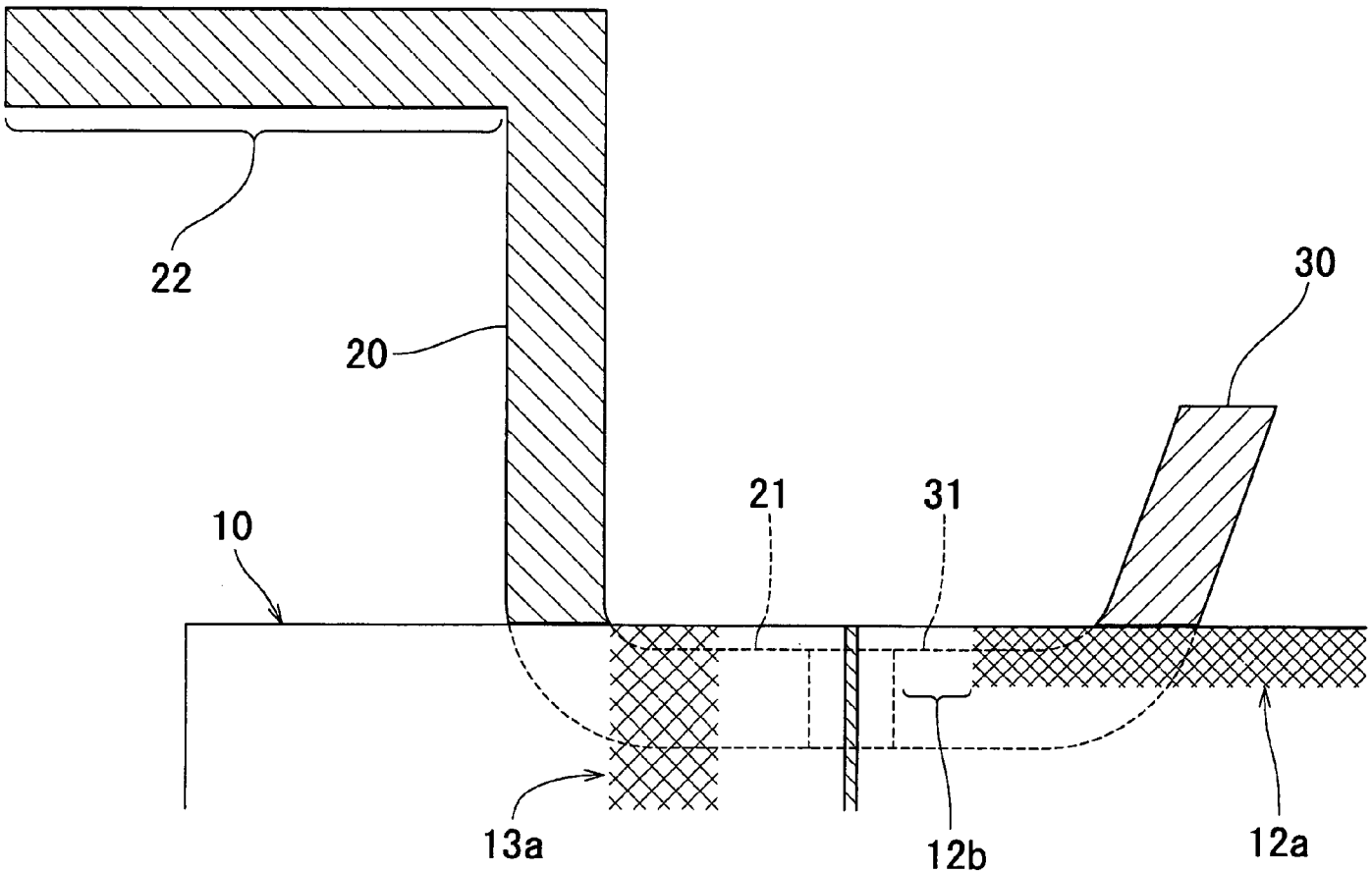
FIG. 5 is a descriptive view illustrating a state in which the reinforcement member is placed on the heat transfer panels of the heat exchange unit according to the embodiment of the present invention, prior to a welding step.
Figure 6A:
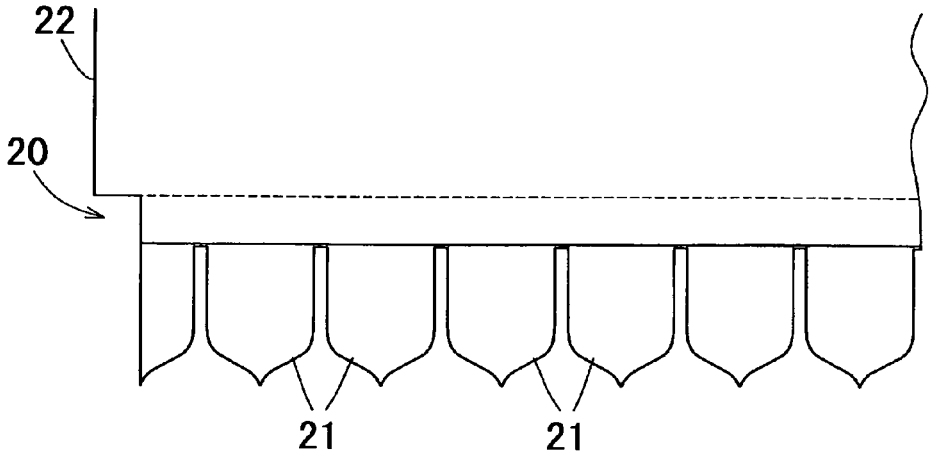
FIG. 6(A) is a partial plan view of the outer reinforcement member of the heat exchange unit according to the embodiment of the present invention, prior to the welding step.
Figure 6B:
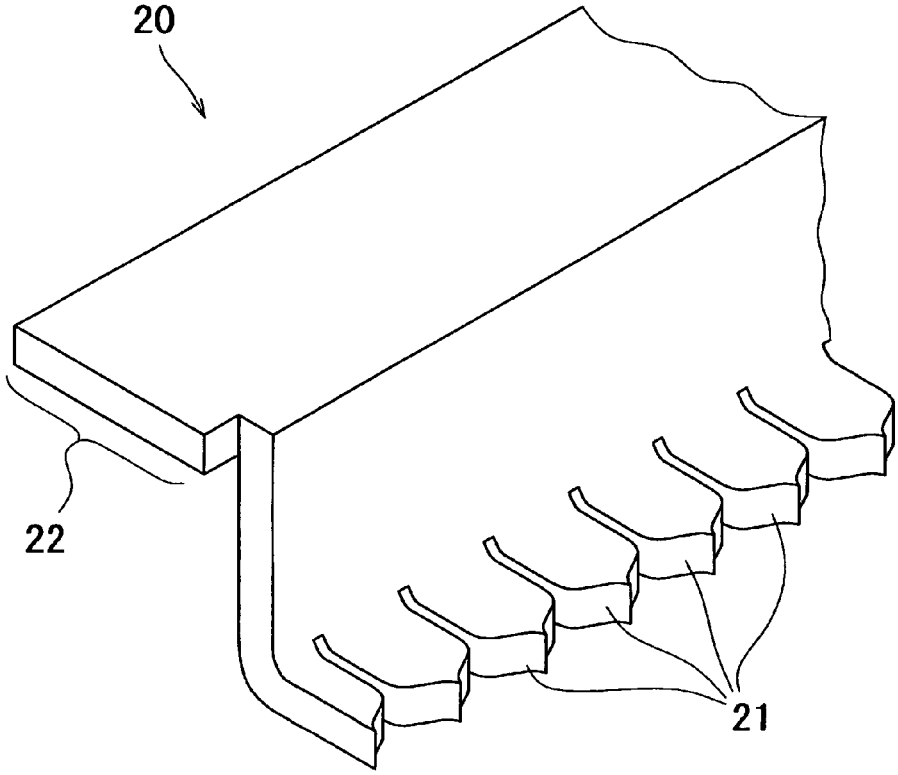
FIG. 6(B) is a partial perspective view of the outer reinforcement member.
Figure 7A:
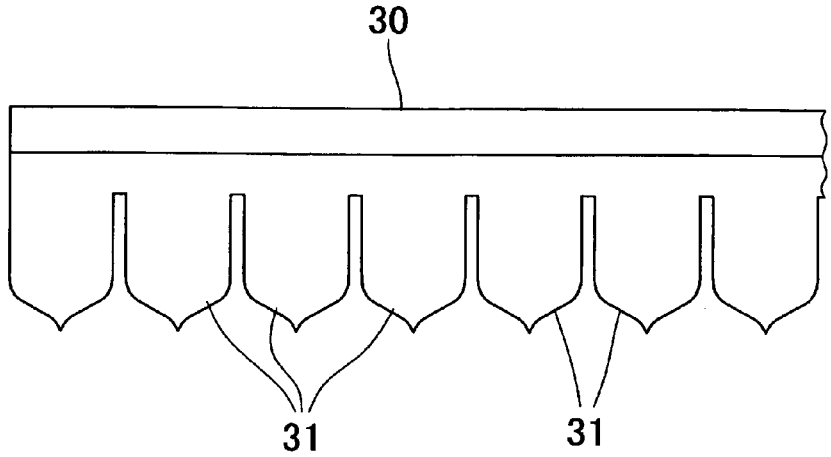
FIG. 7(A) is a partial plan view of the inner reinforcement member of the heat exchange unit according to the embodiment of the present invention, prior to the welding step.
Figure 7B:
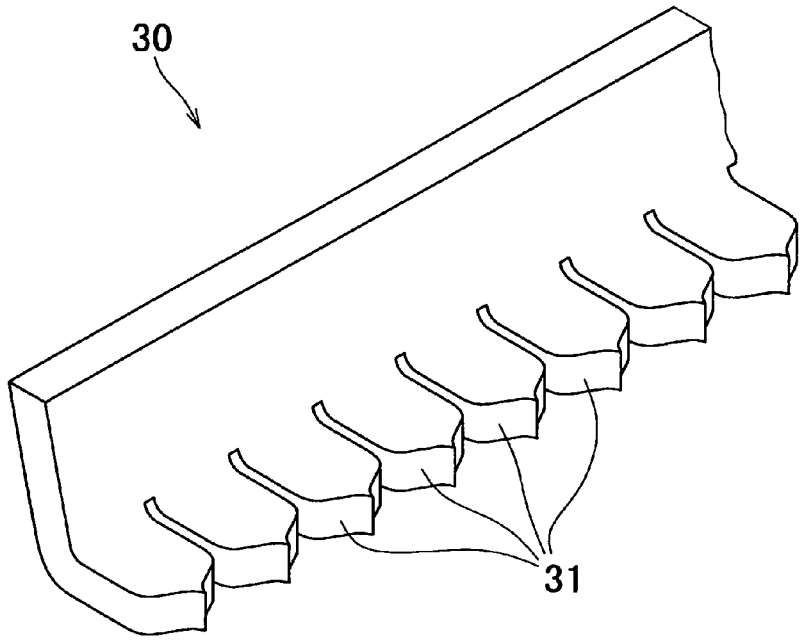
FIG. 7(B) is a partial perspective view of the inner reinforcement member.

Now, the embodiment of the present invention will be described in detail below with reference to FIGS. 1 to 7. FIG. 1 is a side view illustrating a heat exchange unit according to an embodiment of the present invention; FIG. 2 is a plan view illustrating the heat exchange unit according to the embodiment of the present invention; FIG. 3 is an enlarged view illustrating essential elements of the heat exchange unit according to the embodiment of the present invention, in which heat transfer panels and reinforcement members have not as yet been welded together; FIG. 4 is a perspective view of a combined state of the heat transfer panels of the heat exchange unit according to the embodiment of the present invention; FIG. 5 is a descriptive view illustrating a state in which the reinforcement member is placed on the heat transfer panels of the heat exchange unit according to the embodiment of the present invention, prior to a welding step; FIG. 6(A) is a partial plan view of the outer reinforcement member of the heat exchange unit according to the embodiment of the present invention, prior to the welding step; and FIG. 6(B) is a partial perspective view of the outer reinforcement member; FIG. 7(A) is a partial plan view of the inner reinforcement member of the heat exchange unit according to the embodiment of the present invention, prior to the welding step; and FIG. 7(B) is a partial perspective view of the inner reinforcement member.

As is clear from these figures, the heat exchange unit 1 according to the embodiment of the present invention includes heat transfer panels 10 that are formed of a metallic thin sheet into a rectangular shape; outer reinforcement members 20 each of which is formed of a thick metallic plate and has serrations 21; and inner reinforcement members 30 each of which is formed of a thick metallic plate and has serrations 31. The heat transfer panels 10 are welded in parallel and integrally with each other, and the serrations 21, 31 of the reinforcement members 20, 30 are inserted into the gaps between the respective adjacent heat transfer panels 10 and welded together with these panels.

Each of the heat transfer panels 10 is obtained by subjecting the metallic thin sheet having a rectangular shape to a press-forming step utilizing a press-forming machine (not shown) so that a heat transfer area 11 is formed in the central portion of the metallic sheet, terraced flat portions 12 are formed at the predetermined positions, i.e., a pair of opposing sides of the outer periphery of the metallic sheet, by which the heat transfer area 11 is surrounded, and flat portions 13 are formed on the other pair of opposing sides thereof. The above-mentioned heat transfer area 11 having an optimized pattern of irregularity includes opposite surfaces along which high and low temperature fluids respectively flow to make heat exchange between them. Such a pattern of irregularity that includes a wave-formed cross section, which is excellent in heat transfer property, and grooves by which condensed water can be discharged rapidly, is well known. Description of such a pattern is therefore omitted.

In a combined state of the heat transfer panels 10, the first openings through which the first heat exchange fluid flows between the adjacent two heat transfer areas 11 and the second openings through which the second heat exchange fluid flows between the adjacent two heat transfer areas 11 are placed alternately. A pair of heat transfer panels 10 between which the first space is located are water-tightly welded together at corresponding sides except for the terraced flat portion 12 in a state in which respective inner surfaces of the adjacent two terraced flat portions 12 face each other, thus preparing a combined body section. The same step as mentioned above is repeated to prepare a plurality of combined body sections (i.e., unit sections 70). A pair of combined body sections thus prepared are water-tightly welded together at respective outer surfaces of the adjacent two terraced flat portions 12 on the opposite sides of the heat transfer panels 10. The same step as mentioned above is repeated to prepare a single combined body.

At the end of the thus combined body of the heat transfer panels 10, gaps formed between the respective adjacent two terraced flat portions 12 communicate with the openings through into or from which the first heat exchange fluid flows, thus forming the first openings 50. In addition, gaps formed between the respective adjacent two heat transfer panels 10 on the other sides thereof in which the terraced flat portions 12 for forming the first openings 50 do not exists communicate with the openings through into or from which the second heat exchange fluid flows, thus forming the second openings 60.

The outer reinforcement member 20 that is formed of a plate-shaped material having a larger thickness than that of the heat transfer panel 10, is bent along a bending line extending in parallel with the longitudinal direction of the material. The outer reinforcement member 20 is provided at the edge of the thus bent portion thereof with serrations 21 that are fittable to a shape extending the predetermined region at respective ends of the second spaces between the heat transfer panels 10 as combined together, in the vicinity of the first opening 50.

The outer reinforcement member 20 is provided at the opposite edge to the serrations 21 with an extended portion extending by the predetermined length in the opening direction of the heat transfer panels 10. Such an extended portion is provided at its edge with a flat flange 22 that is formed integrally with the extended portion so as to be placed on the front side of the first opening in parallel with the combining direction of the heat transfer panels 10 and away from the ends of the heat transfer panels 10 on the side of the first opening 50. The flange 22 is used as a handle member that is to be held by an operator with his/her hand to move the combined unit of the heat transfer panels 10, as well as a mounting member that is to be secured to a casing (not shown) for the heat exchange unit.

The inner reinforcement member 30 that is formed of a plate-shaped material having a larger thickness than that of the heat transfer panel 10, is bent along a bending line extending in parallel with the longitudinal direction of the material. The inner reinforcement member 30 is provided at the edge of the thus bent portion thereof with serrations 31 that are fittable to a shape extending the predetermined region between the gaps of the heat transfer panels 10 that form the first opening 50.

The serrations 21 of the outer reinforcement member 20 are inserted into the second spaces of the heat transfer panels 10 in the vicinity of the first openings 50 and the serrations 31 of the inner reinforcement member 30 are inserted into the first openings 50 of the heat transfer panels 10. The heat transfer panels 10 are welded to the thus inserted. serrations 21, 31 at their peripheries to combine the heat transfer panels 10 and the outer and inner reinforcement members 20, 30 into the unit.

When the serrations 21 of the outer reinforcement member 20 and the serrations 31 of the inner reinforcement member 30 are inserted into the gaps between the heat transfer panels 10, these serrations 21, 31 reach respective deeper positions, which are sufficiently apart from the edges of the heat transfer panels 10 (see FIG. 5), so as to ensure a large total contact area of the serrations 21, 31 with the heat transfer panels 10, thus preventing the contact area from being easily molten due to heat during the welding.

The side sealing member 40 is formed of the same plate-shaped material as the outer reinforcement member 20 and the inner reinforcement member 30. Such a side sealing member 40 is water-tightly connected to the outer surface of the terraced flat portion 12 of the outermost heat transfer panel 10 of the heat transfer panels as welded together and respective edges of the outer reinforcement member 20 and the inner reinforcement member 30 in the combining direction of the heat transfer panels to prevent the second heat exchange fluid from flowing from a side of the outermost heat transfer panel into the first opening.

Now, description will be given below of a method for assembling the heat exchange unit according to the embodiment of the present invention. A heat transfer panel 10 discharged from a press-formation line in which the press-forming step is applied with the user of a press-forming machine (not shown) is placed on the other heat transfer panel 10 as prepared in the same manner so that their inner surfaces face each other and the top side of the former face the bottom side of the latter. When the heat transfer panel 10 is placed on the other heat transfer panel 10 in this manner, they come into contact with each other at their flat portions 13 excepting the terraced flat portions 12 so as to form a gap between the opposing heat transfer areas 11 thereof, through which gap a fluid can flow.

The thus combined two heat transfer panels 10 are seam-welded at sections of the flat portions 13 of the respective side at the edges of the heat transfer panels in the transverse direction, serving as welding sections, thus preparing a combined body section 70 in which the heat transfer panels are joined by the seam-welded sections 13*a*. The gap between the opposing heat transfer areas 11, i.e., the first space is formed between the heat transfer panels 10 of the combined body section 70. The gap between the terraced flat portions 12 not welded form the first opening 50 communicating with the first space (see FIG. 4).

Such a combined body section 70 is placed on the other combined body section 70 as prepared in the same manner so that the terraced flat portions 12 at the end of the heat transfer panels of the combined body sections 70 come into contact with each other. The gap is formed between the opposing heat transfer areas 11 of the combined body sections 70 so that a fluid can flow in the gap.

The two combined body sections 70 are seam-welded at the terraced flat portions 12 of the opposing heat transfer areas 11 into a unit. The combined body sections 70 thus seam-welded provide the second spaces between the combined body sections 70, and the gaps between the non-welded portions thereof at their end in the transverse direction form the second openings 60 communicating with the second spaces (see FIG. 4). The gap between the terraced flat portions 12 is too narrow for an electrode of the seam welding machine to reach physically the opposite ends of the terraced flat portion 12 for contact thereto. Accordingly, unweldable regions remain on the opposite sides of the seam-welded portions 12*a* over the predetermined length, thus not yet providing a state in which the adjacent heat transfer panels 10 are completely joined without any gap between them.

The same welding is applied to the remaining combined body sections 70 to prepare a single combined body in which all the combined body sections 70 are welded together. Then, the serrations 21 of the outer reinforcement member 20 are inserted into the first spaces placed between the heat transfer panels 10 and the serrations 31 of the inner reinforcement member 30 are inserted into the second spaces placed between the heat transfer panels. In such a state, an arc welding utilizing a consumable electrode such as a MIG welding is applied between the respective inserted serrations 21, 31 of the reinforcement members 20, 30 to weld them together with the edges of the heat transfer panels 10.

In an arc welding operation utilizing the consumable electrode, heat input increases along with increase in an amount of molten electrode. During welding, while moving an electrode unit provided with the electrode wire, which is formed of the same material as the heat transfer plate 10, linearly in the combining direction of the heat transfer panels 10 or zigzag between the outer reinforcement member 20 and the inner reinforcement member 30, the serrations 21, 31 that have a larger thickness than the heat transfer panel 10 and are placed on the opposite surfaces of the heat transfer panel 10 can bear a high heat input. As a result, it is possible to achieve smoothly the welding of the reinforcement members 20, 30 to the heat transfer panels 10 without completely melting the heat transfer panels 10, thus leading to an excellent welding operability. In addition, the heat transfer panels 10 and the reinforcement members 20, 30 are firmly welded together, thus providing a high welding strength. At this stage, the portions of the heat transfer panel 10 that have been left in the form of unweldable region on the opposite side of the terraced flat portion 12 are thermally bonded to the serrations 31 of the inner reinforcement member 30, without providing clearance between them. The reinforcement members 20, 30 are provided in the form of continuous wall on the opposite sides of the welding area. As a result, even when sputters scatter from the welding area during such a welding operation, the above-mentioned continuous wall prevents the sputters from coming into the openings such as the first openings 50. Adverse effects of the sputters on the heat transfer areas and the fluid passages can be prevented.

Then, the side sealing member 40 is placed on an edge of the outermost heat transfer panel 10 and edges of the reinforcement members 20, 30 in the combining direction of the heat transfer panels 10 and welded together with them, thus manufacturing, as a finished product, the heat exchange unit 1 providing with the heat transfer panels 10 in the form of thin plate. In such a combined state as the heat exchange unit 1 into which the heat transfer panels 10 are welded, it is possible to ensure a complete separation between the first openings 50 and the second openings 60 without forming any clearance between them by welding the edges of the heat transfer panels 10 in the vicinity of the first openings 50 to the reinforcement members 20, 30. When the first heat exchange fluid flows in or out from the first spaces through the first openings 50 and the second heat transfer fluid flows in or out from the second spaces, which are opposite to the first spaces relative to the respective heat transfer panels 10, through the second openings 60, there is made heat exchange between the first and second heat exchange fluids.

A complete separation between the first and second openings in a place where the reinforcement members 20, 30 are disposed makes it possible to make design of an inlet and an outlet for the heat exchange fluids in an easy and flexible manner, by modifying connection between the openings and a casing (i.e., a shell) in manufacture of a heat exchanger utilizing the heat exchange unit 1, thus coping with heat exchange for various purposes. When the unit is actually mounted in a casing, the former is fixed to the latter through the flange 22 provided integrally with the outer reinforcement member 20, thus increasing the mounting strength and leading to an easy mounting operation. When a water-tightly sealing condition is kept between the outer reinforcement member 20 and the side sealing member 40 and the casing surrounding them in a mounting state, it is possible to ensure a complete separation between the first openings 50 and the other regions of the unit for the second heat exchange fluid.

According to the heat exchange unit based on the embodiment of the present invention, each of the heat transfer panels 10 formed of a metallic thin sheet having a rectangular shape is provided at two sides thereof with the terraced flat portions 12, these heat transfer panels 10 are welded at their predetermined positions into a unit in which the heat transfer panels 10 are combined in parallel with each other, the outer reinforcement member 20 and the inner reinforcement member 30 having the serrations 21, 31 that have respective shapes matching with the first openings 50 and the second openings 60 of the heat transfer panels are placed on the heat transfer panels 10 in the combining direction thereof, the serrations 21, 31 are inserted into the first and second openings 50, 60 and welded to the heat transfer panels 10 so that the portions of the heat transfer panels 10, which are held between the adjacent serrations 21, 31, are melted together with the reinforcement members 20, 30 to seal the clearance between them. Accordingly, there can be provided welded areas in which the heat transfer panels 10 and the reinforcement members 20, 30 are firmly connected to each other on the side of the first openings 50. It is therefore possible to ensure a completely watertight separation between the first openings 50 and the second openings 60 at the welding positions of the reinforcement members 20, 30 extending in the combining direction of the heat transfer panels 10. In addition, strength of the combined heat transfer panels 10 into the unit can be remarkably enhanced so as to cope with a case where difference in pressure between the heat transfer fluids is relatively large.

Figure 8A:
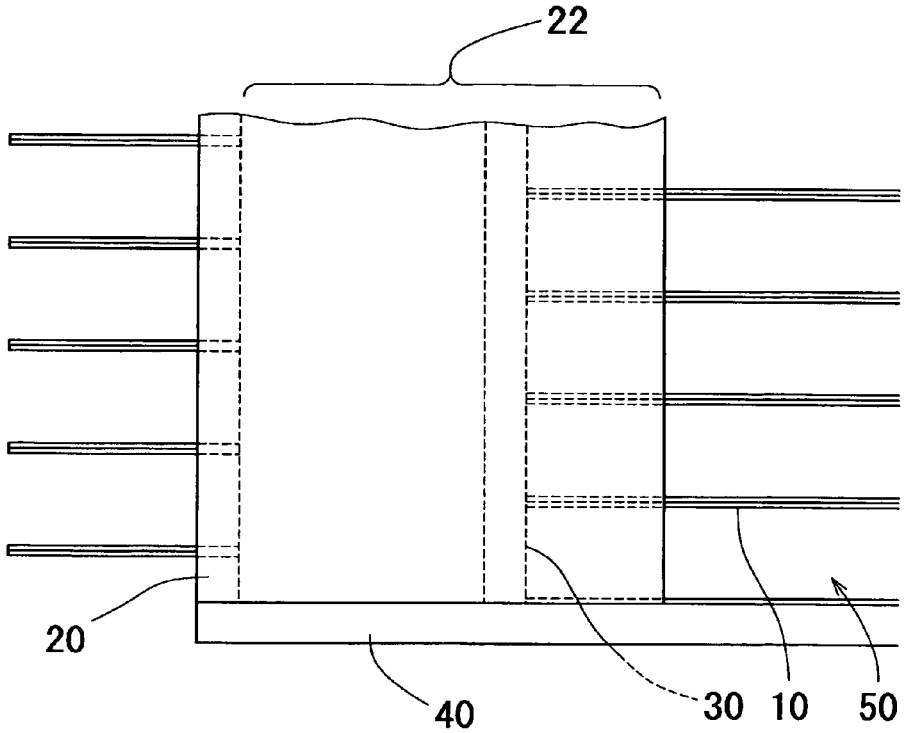
FIG. 8(A) is a descriptive plan view illustrating a state in which a flange of the heat exchange unit according to the other embodiment of the present invention is put in place, and FIB. 8(B) is a descriptive side view illustrating the above-mentioned state.
Figure 8B:
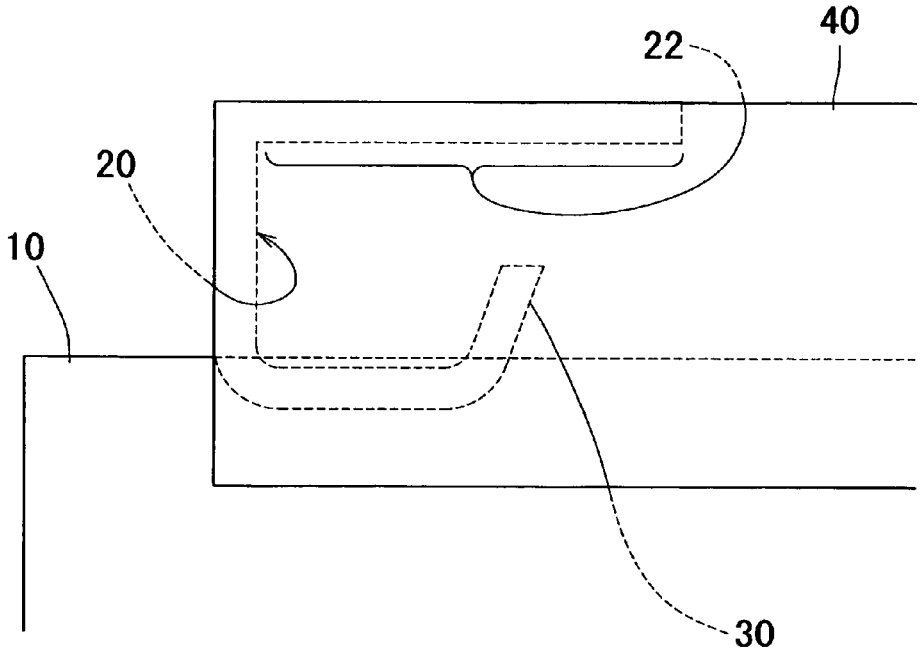
Figure 9A:
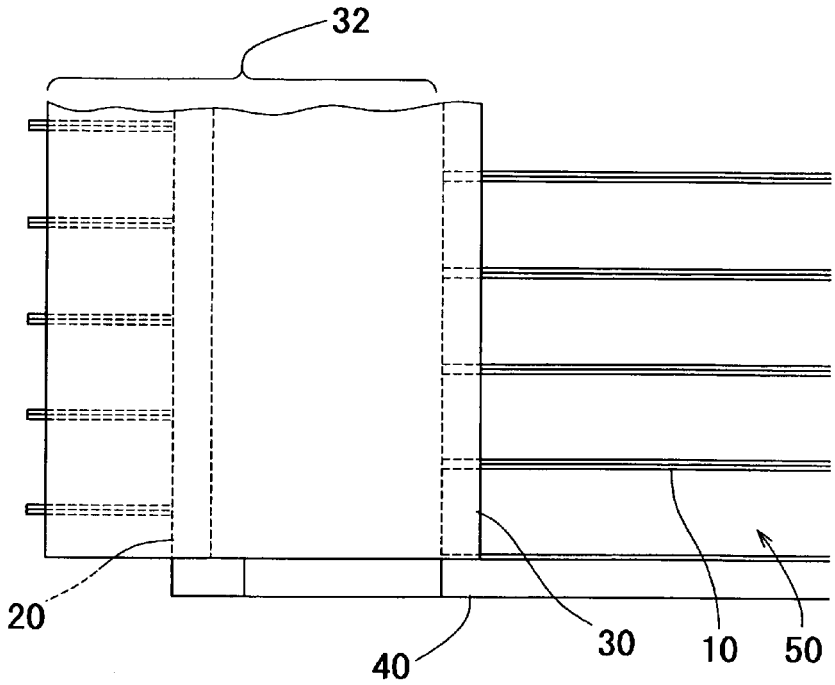
FIG. 9(A) is a descriptive plan view illustrating another state in which the flange of the heat exchange unit according to the other embodiment of the present invention is put in place, and FIB. 9(B) is a descriptive side view illustrating the above-mentioned state.
Figure 9B:
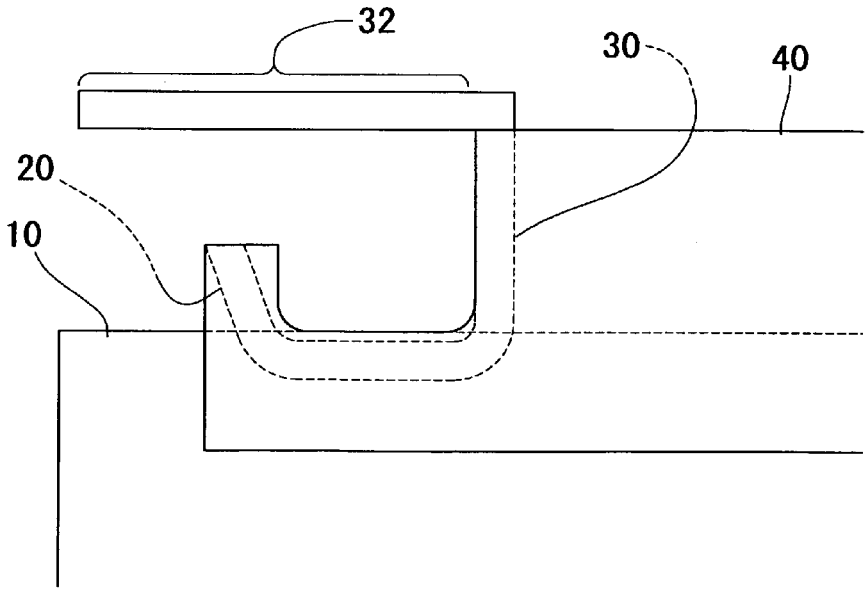

In the heat exchange unit according to the above-described embodiment of the present invention, the flange 22 is provided at the edge of the outer reinforcement member 20 so as to extend outward over the gaps between the heat transfer panels 10. However, the flange 22 may be placed above the welded portions of the reinforcement members 20, 30 to the heat transfer panels 10 as shown in FIGS. 8(A) and 8(B). In such a case, it is possible to minimize an area by which the gaps between the heat transfer panels 10 are covered with the flange 22 together with the welded portions of the reinforcement members 20, 30 to the heat transfer panels 10, thus controlling influence on flow of the heat exchange fluids passing between the heat transfer panels 10. Alternatively, the inner reinforcement member 30 may extend from the opposite end to the serrations 31 in an opening direction of the openings of the heat transfer panels 10 by the predetermined length and a flange 32 may be formed integrally with the extending end of the inner reinforcement member 30, as shown in FIGS. 9(A) and 9(B). In this case, the flange 32 is formed integrally not with the outer reinforcement member 20, but with the inner reinforcement member 30. In order to achieve these structures, there are requirements that the outer reinforcement member 20 or the outer reinforcement member 30 is separated initially from the flange 22 or 32, then, the serrations 21, 31 of the reinforcement members 20, 30 are welded to the heat transfer panels 10, and then, the flange 22 or 32 having a plate-shape is fixed to the edge of the outer reinforcement member 20 or the inner reinforcement member 30 so as to be placed above the welded portions.

Figure 10:
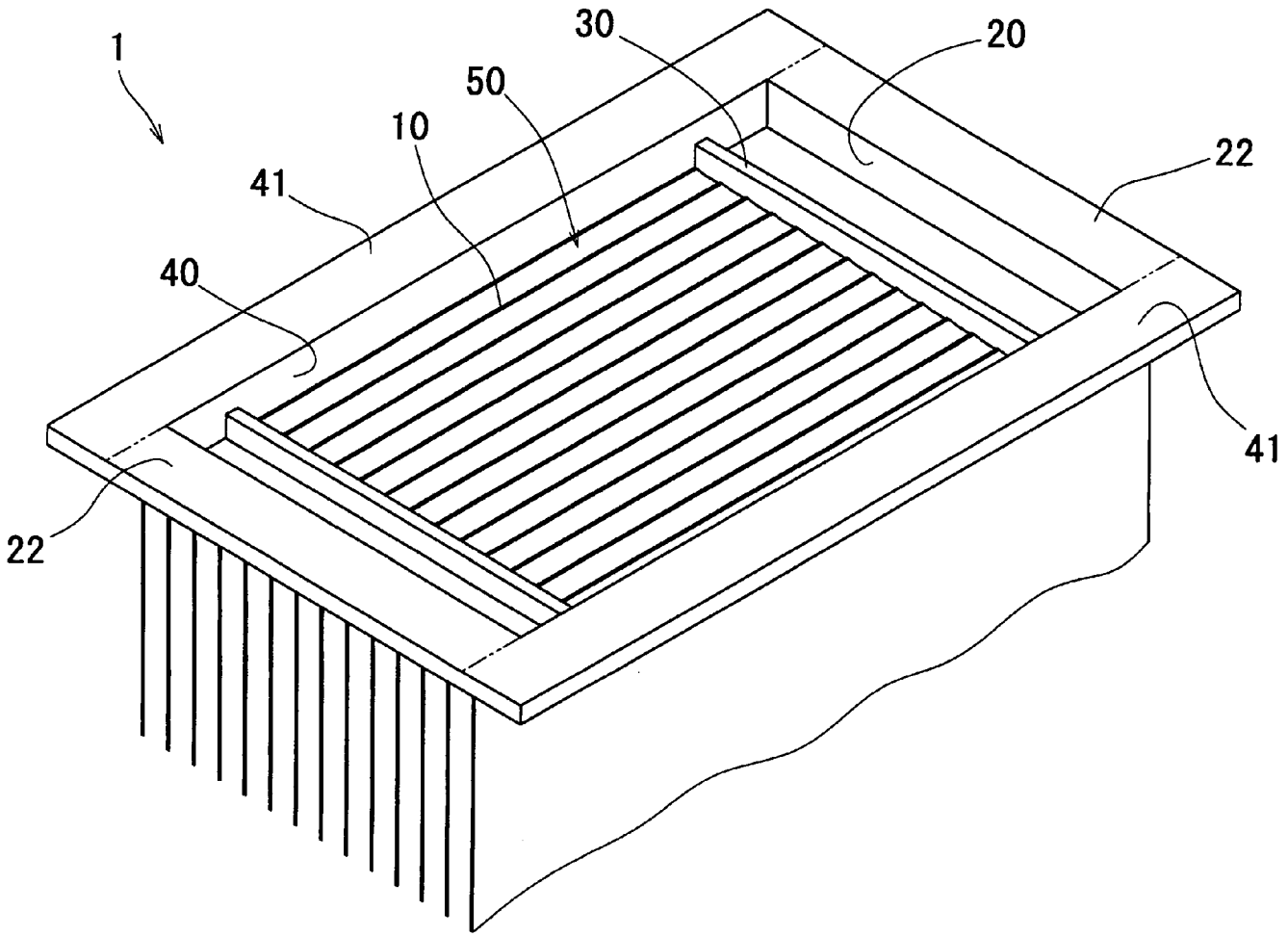
FIG. 10 is a perspective view of the flange of the heat exchange unit according to the other embodiment of the present invention.

In the heat exchange unit according to the embodiment of the present invention, the flange 22 is provided at the edge of the outer reinforcement member 20 so as to extend outward. In addition, the side sealing member 40 may be provided at its edge with a flange 41, as shown in FIG. 10. The above-mentioned flange 41 may be welded to the flange 22 of the outer reinforcement member 20 to form a framework. When the unit of combined panels is mounted in a casing, it is possible to secure the former to the latter through the framework, thus ensuring easily a complete separation between the first openings 50 and the second openings 60 with a sufficient strength.

Figure 11:
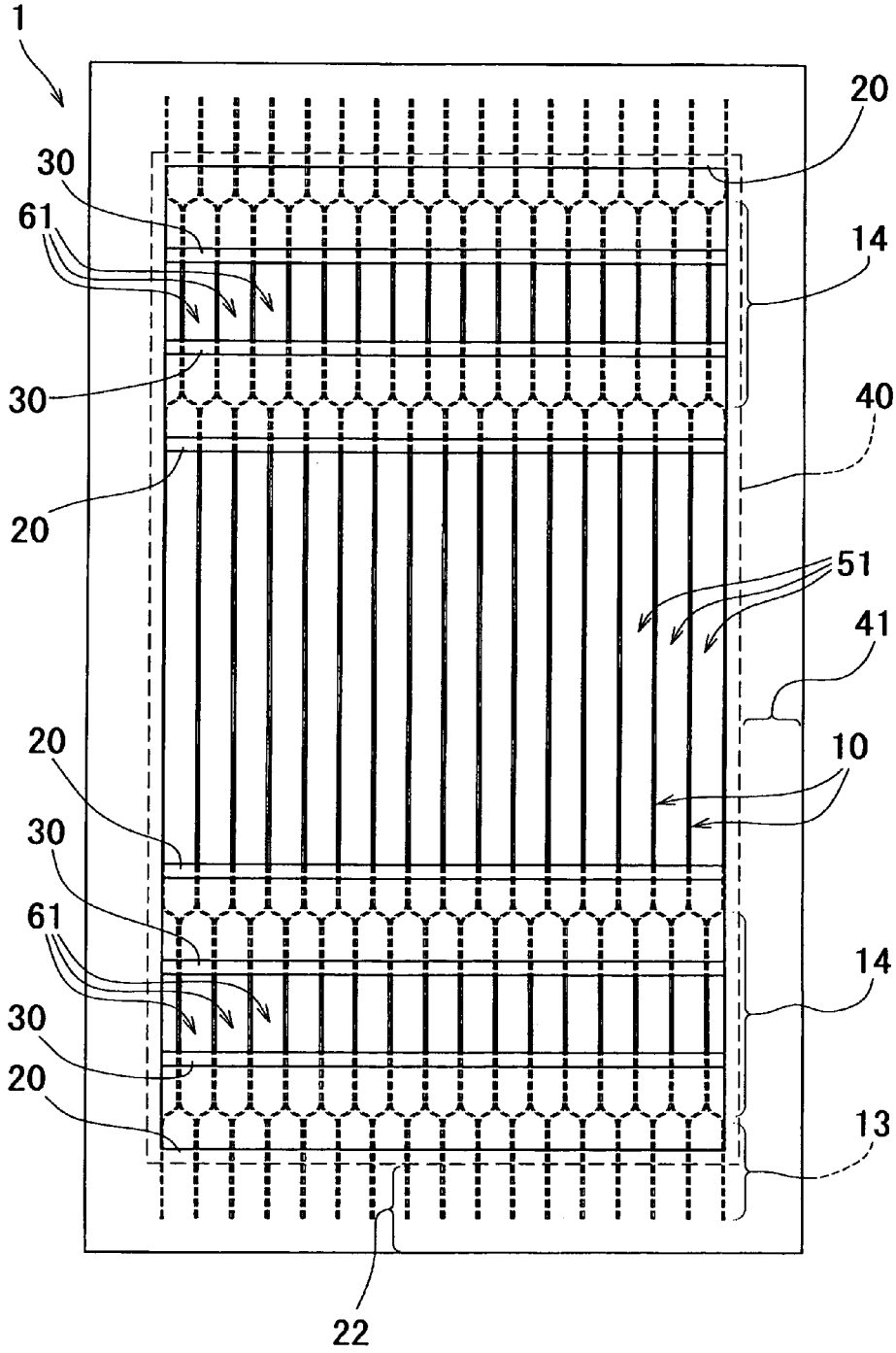
FIG. 11 is a plan view illustrating the heat exchange unit according to the other embodiment of the present invention.

In the heat exchange unit according to the embodiment of the present invention, the first openings 50 through which the first heat exchange fluid is to be introduced between the heat transfer panels 10 are disposed on the opposite sides of the unit in its longitudinal direction, and the second openings 60 are disposed on the opposite sides of the unit in its transverse direction so that the flowing directions of the first and second heat exchange fluids that are separated from each other through the heat transfer panels 10 intersect at right angles. However, the present invention is not limited only to such an embodiment. There may be adopted a structure in which the position of the terraced flat portions 14 at the edges of the heat transfer panels 10 is changed to place the respective first and second openings 51, 61 on the same opposite sides of the unit in its longitudinal direction, the similar reinforcement members 20, 30 are welded to the heat transfer panels 10 at adjacent areas of the first openings 51 to the second openings 61, so that a complete separation of the first openings 51 from the second openings 61 is ensured without forming any clearance connecting them to enable the fluids to be introduced into or discharged from the opposite sides of the unit, as shown in FIG. 11. In this case, heat exchange can be made in a flow relationship between the first and second heat exchange fluids based on a parallel flowing system or a counter-flowing system.

Figure 12:
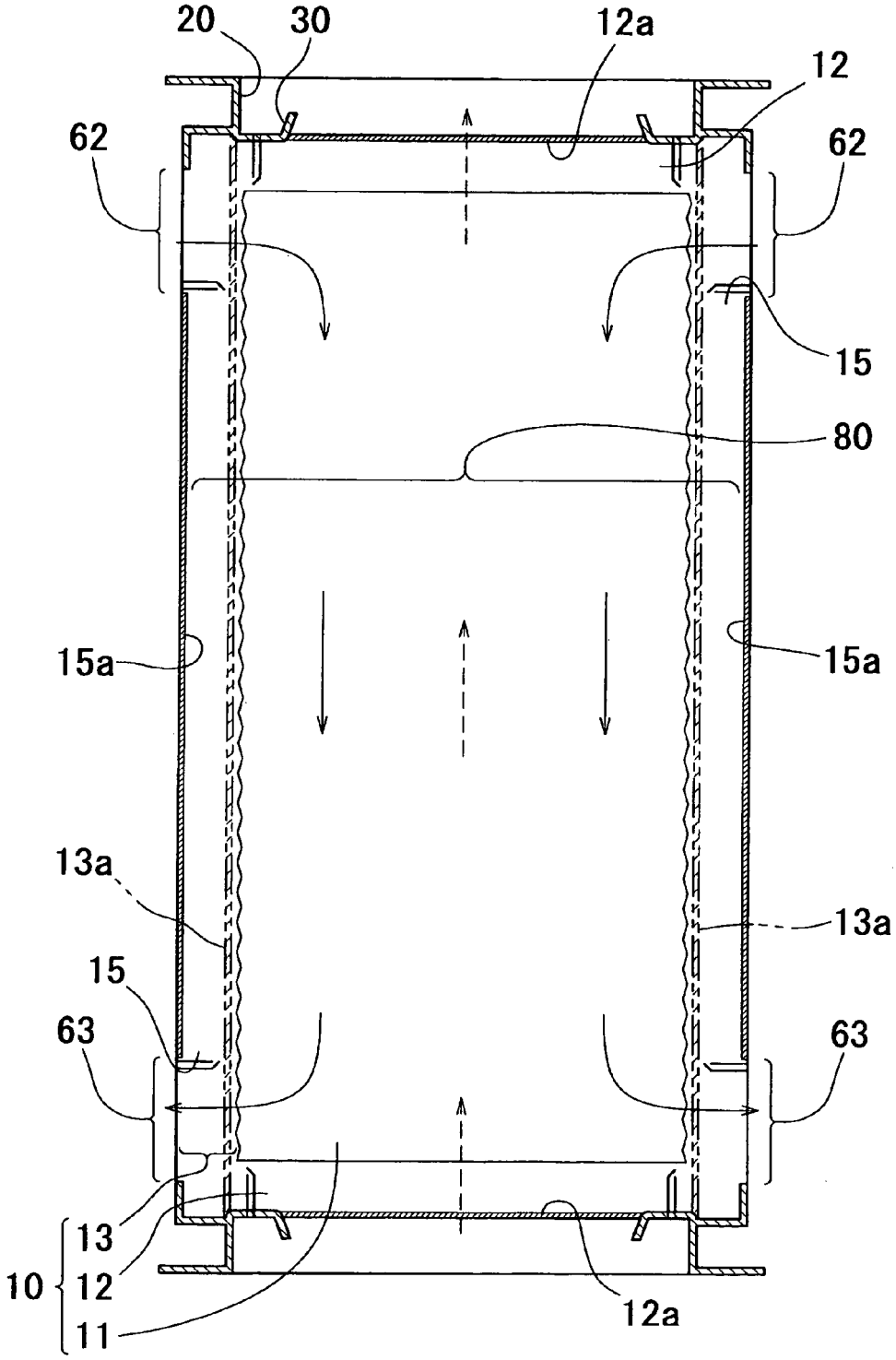
FIG. 12 is a descriptive view illustrating the flow of fluids in the second space of the heat exchange unit according to the other embodiment of the present invention.

In the heat exchange unit according to the embodiment of the present invention, the first openings 50 are placed on the opposite sides of the unit in its longitudinal direction and the second openings 60 are placed on the opposite sides of the unit in its transverse direction over their entire areas so that the second heat exchange fluid flows in the transverse direction of the unit in a flow relationship between the first and second heat exchange fluids based on a cross flowing system. However, the present invention is not limited only to such an embodiment. There may be adopted a structure in which the same structural components as those in the above-described embodiment of the present invention on the opposite sides of the unit in its longitudinal direction for forming the first openings for the heat transfer panels 10 are applied, the terraced flat portions 15 are provided at the central portions of the sides of the heat transfer panels 10, for forming the opposite ends of the unit in its transverse direction, over the predetermined length, the second openings are restricted in their area by the welded portions 15*a* that are formed integrally with the terraced flat portions 15 through the welding of the heat transfer panels 10 into the unit and the four groups of second openings 62, 63 are provided independently from each other at the respective corners of the unit, as shown in FIG. 12. In this case, the second heat exchange fluid flows from the respective groups of second openings 62 at the end of the unit in the longitudinal direction to the respective groups of second openings 62 at the other end thereof so that the second heat exchange fluid is introduced into or discharged from the second openings 62, 63 in the transverse direction of the unit, while the fluid flows between the second spaces 80 for the heat transfer panels 10 in the longitudinal direction of the unit (as shown in solid line-arrows in FIG. 12). Accordingly, heat exchange can be made in a flow relationship between the first heat exchange fluid that flow between the heat transfer panels 10 on their inner side (as shown in dotted line-arrows in FIG. 12) and the second heat exchange fluid, based on a parallel flowing system or a counter-flowing system.

In the heat exchange unit according to the embodiment of the present invention, an arc welding utilizing a consumable electrode such as a MIG welding is applied between the respective inserted serrations 21, 31 of the reinforcement members 20, 30 to weld them together with the edges of the heat transfer panels 10. However, the present invention is not limited only to such an embodiment. In order to perform the welding, there may be applied another type of welding method such as a TIG welding that can provide an equal amount of heat input as the MIG welding and supply an appropriate amount of filler material so as to perform a smooth welding of the reinforcement members 20, 30 and the heat transfer panels 10.

What is claimed is:

1. A heat exchange unit, comprising a plurality of heat transfer panels, which are formed of a metallic thin sheet and combined in parallel and integrally with each other, each of said heat transfer panels being provided with opposite surfaces with which first and second heat exchange fluids are to come into contact, respectively, first spaces through which the first heat exchange fluid is to pass and second spaces through which the second heat exchange fluid is to pass being provided alternately, and first openings communicating respectively with said first spaces to cause the first heat exchange fluid to flow into and out from said first spaces and second openings communicating respectively with said second spaces to cause the second heat exchange fluid to flow into and out from said second spaces being provided separately from each other, wherein:

each of said heat transfer panels is formed into a rectangular shape, and provided at one or more position in at least a pair of opposite sides in an outer periphery thereof with a terraced flat portion that is elevated from an area therearound;

of said plurality of heat transfer panels, adjacent two heat transfer panels between which the first space is located are water-tightly welded together at corresponding sides except for said terraced flat portion in a state in which respective inner surfaces of adjacent two terraced flat portions face each other so that a first gap between opposing two terraced flat portions communicates with the first opening, and adjacent two heat transfer panels between which the second space is located are water-tightly welded together at outer surfaces of adjacent two terraced flat portions, to provide an integrally assembled body in which the first gaps between the terraced flat portions disposed in parallel with each other serve as said first openings;

there is provided an outer reinforcement member having a plurality of serrations placed in a row, each of said serrations having a shape by which a second gap between the adjacent heat transfer panels is substantially closed over a predetermined area in a vicinity of the first space on an end side thereof, said outer reinforcement member being formed of a same material as the heat transfer panel and having a larger thickness than the heat transfer panel, said each of serrations being inserted into said predetermined area of the second gap to place said outer reinforcement member in a combining direction of the heat transfer panels;

there is provided an inner reinforcement member having a plurality of serrations placed in a row, each of said serrations having a shape by which the first gap between the adjacent heat transfer panels is substantially closed over a predetermined area in a vicinity of the second gap on an end side thereof, said inner reinforcement member being formed of the same material as the heat transfer panel and having a larger thickness than the heat transfer panel, said each of serrations being inserted into said predetermined area of the first gap to place said inner reinforcement member in a combining direction of the heat transfer panels; and each of the serrations of said outer and inner reinforcement members are welded to the heat transfer panels at predetermined regions without forming a clearance between the serrations and the heat transfer panels.

2. The heat exchange unit as claimed in claim 1, wherein:

the adjacent heat transfer panels between which said second space is placed are combined into a united body by a seam welding at weldable regions on the outer surfaces of the adjacent two terraced flat portions;

each of the serrations of said inner reinforcement member has a length so that the serrations is capable of existing on at least a side of each of both ends of the terraced flat portions as combined, an electrode of a seam welding machine being incapable of physically extending to said at least the side to provide an unweldable region; and welding applied between the serrations that are inserted into the first gaps between the terraced flat portions forming the first openings over said unweldable region causes the heat transfer panels to be welding simultaneously together.

3. The heat exchange unit as claimed in claim 1 or 2, wherein:

said outer reinforcement member and/or said inner reinforcement member is provided at an opposite edge to said serrations with a flange that is substantially flat, said flange being to be in parallel to the combining direction of the heat transfer panels and spaced apart from an edge of the first opening of the adjacent two heat transfer panels.

4. The heat exchange unit as claimed in any one of claims 1 or 2 wherein:

said welding applied between the serrations of said outer reinforcement member and said inner reinforcement member is carried out by an arc welding with a consumable electrode having a wire-shape, in which an electrode unit provided with the electrode is moved between the outer reinforcement member and the inner reinforcement member, while generating an arc between said electrode, and the serrations of the outer reinforcement member, the serrations of the inner reinforcement member and the heat transfer panels, whereby the serrations of the outer reinforcement member, the serrations of the inner reinforcement member and the heat transfer panels are welded together with said electrode formed of a same material thereof.

5. The heat exchange unit as claimed in any one of claims 1 or 2, further comprising:

a side sealing member that is water-tightly connected to the outer surface of said terraced flat portion of an outermost heat transfer panel of the heat transfer panels as welded together and respective edges of said outer reinforcement member and said inner reinforcement member in the combining direction of the heat transfer panels to prevent the second heat exchange fluid from flowing from a side of said outermost heat transfer panel into said first opening.

6. The heat exchange unit as claimed in claim 5, wherein:

said side sealing member is provided at its edge that is away from a joined portion of the side sealing member to said heat transfer panel, with a flange that is substantially flat, said flange extending outward or inward relative to the first opening by a predetermined length.

7. The heat exchange unit as claimed in claim 3 wherein:

said welding applied between the serrations of said outer reinforcement member and said inner reinforcement member is carried out by an arc welding with a consumable electrode having a wire-shape, in which an electrode unit provided with the electrode is moved between the outer reinforcement member and the inner reinforcement member, while generating an arc between said electrode, and the serrations of the outer reinforcement member, the serrations of the inner reinforcement member and the heat transfer panels, whereby the serrations of the outer reinforcement member, the serrations of the inner reinforcement member and the heat transfer panels are welded together with said electrode formed of a same material thereof.

8. The heat exchange unit as claimed in claim 3, further comprising:

a side sealing member that is water-tightly connected to the outer surface of said terraced flat portion of an outermost heat transfer panel of the heat transfer panels as welded together and respective edges of said outer reinforcement member and said inner reinforcement member in the combining direction of the heat transfer panels to prevent the second heat exchange fluid from flowing from a side of said outermost heat transfer panel into said first opening.

9. The heat exchange unit as claimed in claim 4, further comprising:

a side sealing member that is water-tightly connected to the outer surface of said terraced flat portion of an outermost heat transfer panel of the heat transfer panels as welded together and respective edges of said outer reinforcement member and said inner reinforcement member in the combining direction of the heat transfer panels to prevent the second heat exchange fluid from flowing from a side of said outermost heat transfer panel into said first opening.

10. The heat exchange unit as claimed in claim 3, wherein:

said side sealing member is provided at its edge that is away from a joined portion of the side sealing member to said heat transfer panel, with a flange that is substantially flat, said flange extending outward or inward relative to the first opening by a predetermined length.

11. The heat exchange unit as claimed in claim 4, wherein:

said side sealing member is provided at its edge that is away from a joined portion of the side sealing member to said heat transfer panel, with a flange that is substantially flat, said flange extending outward or inward relative to the first opening by a predetermined length.

* * * * *